United States Patent [19]

Drummond et al.

[11] 3,997,308

[45] Dec. 14, 1976

[54] APPARATUS FOR GATHERING FIBERS INTO A PLURALITY OF SPACED APART STRANDS

[75] Inventors: Warren W. Drummond, Allison Park; Robert H. Walters, Freeport, both of Pa.

[73] Assignee: PPG Industries, Inc., Pittsburgh, Pa.

[22] Filed: Mar. 31, 1975

[21] Appl. No.: 565,985

[52] U.S. Cl. ..... 65/11 W; 28/75 R; 65/2; 118/234; 226/197

[51] Int. Cl.[2] ..... C03B 37/02

[58] Field of Search ..... 65/11 R, 11 W, 2; 226/102, 197; 28/71.3, 75 R; 118/234

[56] References Cited

UNITED STATES PATENTS

| | | | |
|---|---|---|---|
| 3,293,013 | 12/1966 | Drummond | 65/11 W X |
| 3,309,037 | 3/1967 | Amos | 226/97 X |
| 3,506,419 | 4/1970 | Smith et al. | 65/11 W X |
| 3,543,981 | 12/1970 | Morrison et al. | 226/11 |
| 3,887,970 | 6/1975 | Drummond | 65/4 A X |

FOREIGN PATENTS OR APPLICATIONS

| | | | |
|---|---|---|---|
| 248,763 | 9/1912 | Germany | 226/197 |

*Primary Examiner*—Robert L. Lindsay, Jr.
*Attorney, Agent, or Firm*—Alan T. McDonald

[57] ABSTRACT

An apparatus for gathering individual glass fibers into spaced apart strands is disclosed. The individual fibers, during formation are passed over an applicator which applies a lubricant to the fibers. A circular cylindrical bar member, at an oblique angle to the application surface, contacts the spaced apart strands, and in conjunction with a cylindrical free wheeling roller, causes the fibers to be consolidated into a plurality of spaced apart strands according to the natural filament split.

7 Claims, 3 Drawing Figures

APPARATUS FOR GATHERING FIBERS INTO A PLURALITY OF SPACED APART STRANDS

BACKGROUND OF THE INVENTION

This invention relates to an apparatus for gathering individual fibers or filaments into a plurality of spaced apart strands.

Glass fibers are formed by being drawn at a high rate of speed from molten cones of glass located at the tips of small orifices in a bushing such as shown in U.S. Pat. No. 2,133,238 incorporated herein by reference. During formation, the filaments are coated while moving at a speed in excess of 25 up to 100 meters per second with a size which contains a lubricant for the filaments to prevent destruction of the strand by abrasion of the individual filaments against each other or against fiber handling equipment. By "lubricant" as used herein, is meant to include water as well as organic and inorganic lubricants as long as the lubricant provides filament protection.

In the production of glass fibers for use in textile and resin matrix reinforcement, the pulling or attenuating force for drawing the fibers or filaments is provided by a rotating drum, wheel pullers or by drawing the fibers between a pair of contacting flexible surfaces.

To produce various fiber glass products, it is desirable to gather the individual fibers or filaments into a plurality of spaced apart strands in parallel relationship. One such product is shown in U.S. Pat. No. 3,887,970 entitled "Crimped Fiber Glass and Method of Producing Same" by Warren W. Drummond incorporated herein by reference. Further, spaced apart strands are utilized in the production of continuous glass fiber mat wherein the fibers are formed, gathered into a plurality of spaced apart strands and deposited on a conveyor.

Normally, the individual fibers or filaments are gathered into a plurality of strands by a graphite gathering shoe which has the same number of grooves therein as the number of strands to be formed. Also, combs are sometimes used to form the plurality of spaced apart strands.

SUMMARY OF THE INVENTION

According to the present invention glass fibers or filaments are formed at tips in a fiber forming bushing. The individual fibers are passed over an applicator where a lubricant is applied to the individual fibers. Because the lubricant is either water or in aqueous media, the surface tension of the water binds the fibers into a plurality of subgroups. Each of such subgroups usually contains about 5 to 75 filaments. The number of subgroups depends on the geometry of the fiber forming equipment and the arrangement of the tips in the bushing. The subgroups are caused to be distinctly separated from each other to form a plurality of spaced apart strands by passing the subgroups over a circular cylindrical bar member parallel to the axis of the bar member, and then over a right circular cylindrical free wheeling roller. The spaced apart strands are maintained in parallel relationship due to the passage over the bar and roller. The spaced apart strands are pulled by an attenuation means such as a pair of flexible belts with contacting surfaces which grip and attenuate the strands and the individual fibers associated therewith.

The bar member is oriented at an angle oblique to the application surface of the applicator and downwardly therefrom when the applicator and the bar surface member are interpolated into touching relationship. The roller is oriented perpendicular to the application surface and the application surface and the bar member create an acute angle.

The instant invention is further elucidated with the following description of the drawings.

Figure 1:
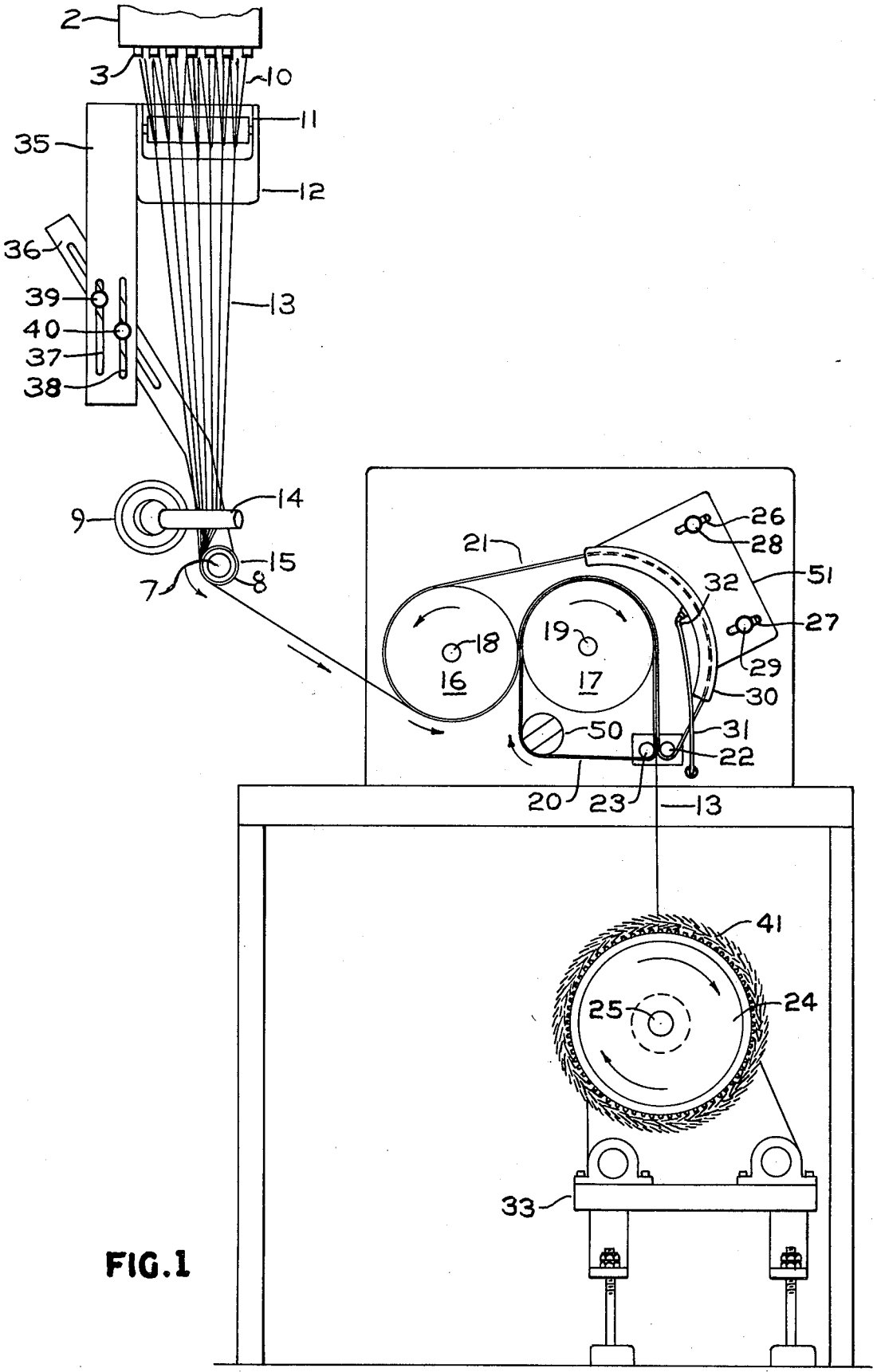
FIG. 1 represents a view in perspective of one embodiment of the invention, separating the strands which are to form a mat.
Figures 2, 3:
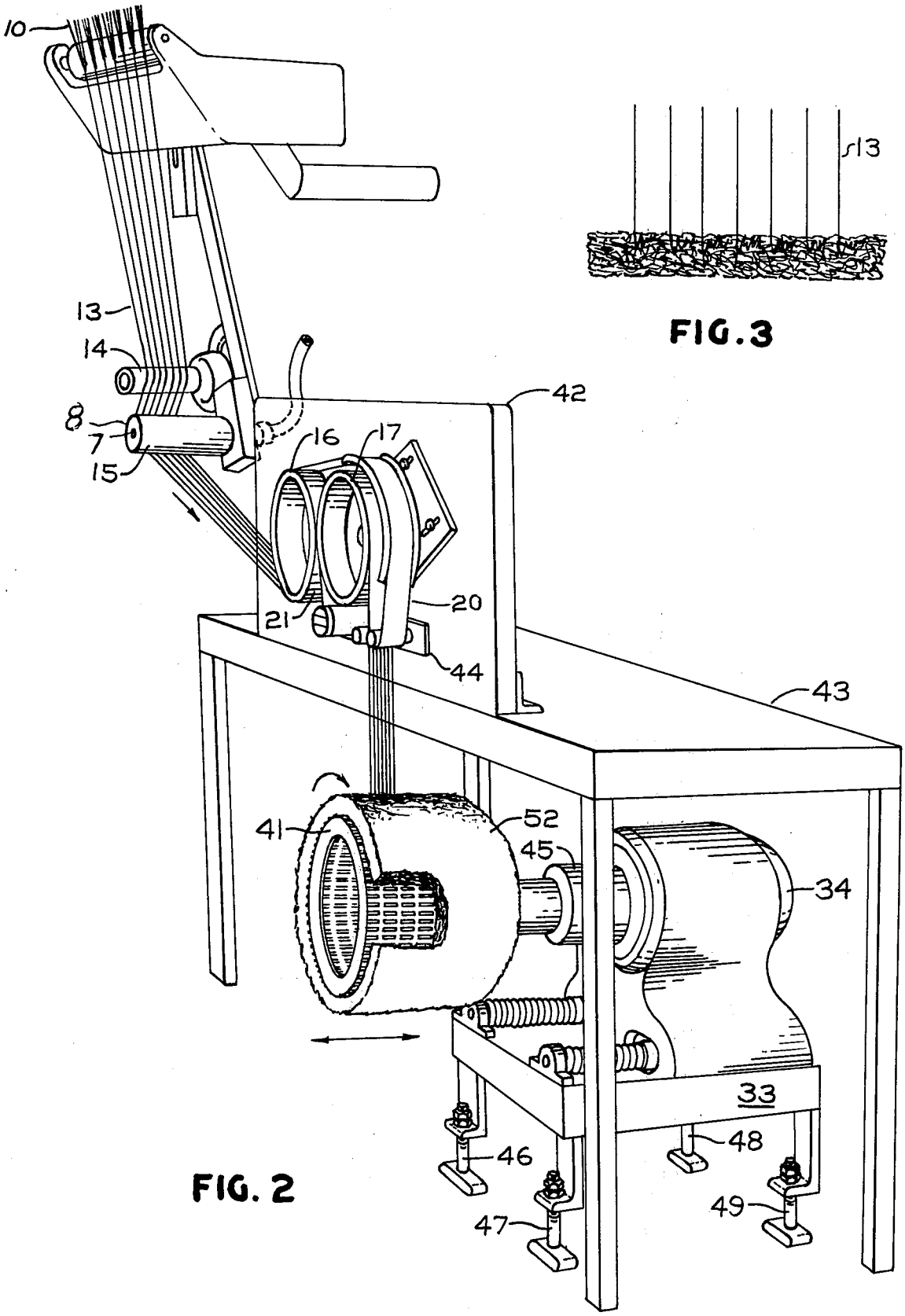
FIG. 2 is a side elevational view in perspective of the apparatus of FIG. 1.
FIG. 3 is a diagrammatic illustration of the spaced apart strand in parallel relation forming a mat by the apparatus of FIGS. 1 and 2.

Turning to the drawings, in FIGS. 1 and 2 there is shown a plurality of glass fibers 10 being drawn across a roller applicator 11 housed in a reservoir 12 with suitable lubricant being applied to the fibers as they are being drawn across the applicator 11. The applicator is held in place by a bracket 35 having a side arm 36 associated therewith which is adjustable in a vertical direction utilizing the slots 37 and 38 and the bolts 39 and 40. Located on the lower end of the side arm bracket 36 is the roller 15. Positioned directly above the guide shoe 15 and positioned at an angle to the long axis thereof is a bar member 14.

After the fibers are sized and/or lubricated the surface tension of the size and/or lubricant brings the fibers together into spaced apart groups 13, at the applicator 11. These spaced apart groups 13, are discrete strands. Applicators which are useful in the practice of the invention are the roller type applicators and continuous belt applicators. Two of such applicators are shown in U.S. Pat. Nos. 2,728,972 and 2,873,718 incorporated herein by reference.

As is illustrated in FIGS. 1 and 2 of the drawings, the right circular cylindrical separating bar 14 is mounted at an angle oblique to the axis of the applicator 11, and creates an acute angle with the applicator surface when the application surface and the bar member are interpolated into touching relationship. The roller 15 is approximately perpendicular to the axis of the applicator 11. A ball and socket joint, 9, is fixedly attached to the bar member 14 to provide adjustment of the bar member 14. The bar member 14 is preferably contructed of graphite to provide adequate lubricity for the strands 13 to pass thereover.

The applicator surface 11 and the bar 14 create an acute angle which is preferably 30 to 45 degrees when the application surface 11 and the bar 14 are interpolated to be in touching relationship.

The roller 15 is constructed of a sleeve 8 which rotates on a bearing in the housing 7.

Also shown in the drawing are two pulleys 16 and 17 which are rotated by drive shafts 18 and 19 associated with a suitable motor not shown. Pulley 16 has a belt 21 associated therewith. Pulley 19 has a belt 20 associated therewith. Tension on the belts can be adjusted by movement of the plate member 51 utilizing slots 26 and 27 therein and the set screws or bolts 28 and 29. Associated with the belt 21 is an air shoe 30 having a suitable air supply line 31 and an air distributing cap 32. Belts 21 and 20 turn around stationary pins 22 and 23 respectively with belt 20 passing over idler 50. Located beneath the stationary pins 22 and 23 is a rotatable mandrel or collet 24 driven by a shaft member 25 associated with a suitable motor 34. The motor is mounted on a table 33 and may be leveled utilizing the leveling foot members 46, 47, 48 and 49 associated with the table 33. Ridges 41 are provided on the surface of the rotating collet 24 to assist in the collection of fibers on that surface and to permit the finished fiber glass mass or mat to be removed easily from the surface of the rotating mandrel 24.

In FIG. 3 a portion of a mat formed on the rotating mandrel 24 of FIG. 2 and cut from the surface of the mat 52 shown therein depicts the orientation of the crimped glass fibers as they appear in the finished product. It is to be noted that the fibers are interlocked and that the projection of the separated fiber glass strands 13 onto the mat surface as it is being formed is such that the penetration to a considerable depth below the surface of the mat as it is being formed is accomplished due to the high velocity of travel of the fibers as they are collected on the slowly rotating mandrel. Thus, the high inertial forces provide crimped fibers which as the mat is formed provide a mat structure which has the appearance of a needled mat though no needling was used. The spaced apart strands 13 are maintained in parallel form by the strand spreader 14 in conjunction with the roller 15 to provide the spaced apart relationship and parallelism required for the formation of such mat.

In operation of the embodiments shown in FIGS. 1 and 2, fiber glass filaments 10 are drawn from tips 3 in a bushing 2, across an applicator 11 where a suitable lubricant such as an amino silane is applied thereto. Any conventional glass fiber lubricant may be used, providing the resultant crimped fibers are not lubricated to the extent that the crimp releases due to a lack of friction. Typical of lubricants found acceptable for these purposes are water, gamma methacryloxypropyl silane, gamma amino propyl silane, emulsified epoxy resins and the like. The filaments 10 as they are drawn downwardly across the applicator associate into subgroups 13 containing 5 to 75 filaments. These subgroups 10 are spaced apart strands 13 because of passage over the spreading bar 14. The strands are passed across the spreading bar 14, which is positioned slightly across the guideshoe 15 and imparts sufficient force to the fibers as they are being drawn around the guideshoe 15 to maintain the strands in a separated and parallel position as they pass under the shoe 15. The fibers are then picked up on the underside of the belt 21 as it revolves about pulley 17. Belts 21 and 20, with the separated strands sandwiched in between, travel around the pulley 17 and downwardly until they reach the stationary pins 22 and 23. At this point the parallel spaced apart strands 13 are projected downwardly at high speed until they reach the stationary pins 22 and 23. At this point strands 10 are projected downwardly at high speed until they strike the surface 41 of the rotating collet 24. Upon striking this surface, which is at right angles to the path of travel of the strands, each of the strands is bent as the strand travels to the surface on the approximate order of 2 to 4 sharp bends or more per linear inch of strand. The bends are counted by measuring a length of the product in the stretched condition and relaxing it after measurement of its length to count the flexes in the length measured. The strands 13 as they travel over the stationary pins 22 and 23 travel at rates of speed varying between 5,000 to 20,000 feet per minute (25 to 100 meters per second). When the strands have reached the desired depth, the mat is pulled from the collet and the mandrel is ready for further collection of strands. The motor 34 associated with the collet 24 in addition to imparting rotational movement to the winder or collet 24 reciprocates in a horizontal direction at speeds of travel between 3 and 30 feet per minute ($1.5 \times 10^{-2}$ and $1.5 \times 10^{-1}$ meters per second) thereby permitting the strand to build up across the face of the periphery of the winder 24 while the winder 24 is being rotated at slow speed. This provided for a uniform deposition of strand across the surface 41 of the winder 24 and while it is rotating to provide for uniform deposition of strand across the surface 41 of the winder 24 and while it is rotating to provide for uniform deposition around the winder also. Donut shaped packages of crimped fiber glass of any uniform thickness are thereby formed on the winder 24.

In starting the process shown in FIGS. 1 and 2, the filaments 10 are attenuated by hand, passed over the spreader bar 14 around the roller 15 and threaded between the attenuation belts 20 and 21 while the attenuator belts are moving. The position of the spreader bar 14 is adjusted while the fibers 10 are being attenuated to provide the optimum angle for orienting the filaments 10 into a plurality of spaced apart strands 13. Once the desired spacing between the strands is obtained, the ball and socket joint 9 sets the bar 14 in a permanent position. The optimum angle created by the spreader bar 14 and the applicator surface 11 is usually between 30 and 45 degrees when the applicator surface and the spreader bar are interpolated to be in touching relationship. Further, rather than passing the strands 13 between the spreader bar 14 and the roller 15, the strands 13 can be passed on the opposite side of the spreader bar 14 and over the roller 15 to provide spaced apart strands 13.

In place of the attenuator, a conventional high speed winder may be utilized to attenuate and collect the spaced apart strand. Hence, a forming package composed of spaced apart strands will be produced for use in textiles or reinforcements.

While the invention has been described with reference to certain specific examples and illustrative embodiments, the invention is not intended to be limited except insofar as is set forth in the accompanying claims.

I claim:

1. In an apparatus for forming glass fibers comprising: a bushing having a plurality of orifices therein from which glass fibers are drawn; an applicator for applying a lubricant to the individual fibers; means for gathering said fibers into a plurality of strands; and means for applying attenuating forces to said strands and the individual filaments associated therewith, the improvement wherein said means for gathering the fibers into a plurality of spaced apart strands comprises a circular cylindrical bar member oriented at an acute angle to the application surface of said applicator over which the fibers pass, said angle being determined when said application surface and said bar member are interpolated to be in touching relationship, and a circular cylindrical roller oriented approximately perpendicular to the application surface of said applicator to provide gathering of the individual fibers into a plurality of spaced apart strands by sequentially passing the fibers over said applicator, over said bar member and over said roller.

2. The apparatus of claim 1 wherein said means for applying attenuative forces to said strands and the fibers associated therewith is provided by a winder.

3. The apparatus of claim 1 wherein said bar is capable of being adjusted in order to alter said angle created by said bar and said application surface.

4. The apparatus of claim 1 wherein said bar member and said application surface creates a 30 to 45 degree angle when said bar member and said application surface are interpolated to be in touching relationship.

5. The apparatus of claim 1 wherein said bar is constructed of graphite.

6. The apparatus of claim 1 wherein said roller is a metal sleeve mounted on a bearing.

7. The apparatus of claim 1 wherein said means for applying attenuative forces to said strands and the fibers associated therewith is provided by two moving flexible high speed surfaces which grip the strand between them.

* * * * *